United States Patent [19]

Lefevre et al.

[11] Patent Number: 4,766,871

[45] Date of Patent: Aug. 30, 1988

[54] PROCESS AND SYSTEM OF ELECTRONIC INJECTION WITH REGULATION BY PROBE λ FOR INTERNAL COMBUSTION ENGINE

[75] Inventors: Rémi Lefevre, Colombes; Francis Prampolini, Antony, both of France

[73] Assignee: Regie Nationale Des Usines Renault, Boulogne Billancourt, France

[21] Appl. No.: 18,530

[22] Filed: Feb. 25, 1987

[30] Foreign Application Priority Data

Feb. 25, 1986 [FR] France ..... 86 02557

[51] Int. Cl.[4] ..... F02M 51/00

[52] U.S. Cl. ..... 123/489

[58] Field of Search ..... 123/440, 478, 480, 486, 123/489, 589

[56] References Cited

U.S. PATENT DOCUMENTS

| | | | |
|---|---|---|---|
| 4,111,171 | 9/1978 | Aono et al. | 123/440 |
| 4,282,842 | 8/1981 | Sasayama | 123/440 |
| 4,337,746 | 7/1982 | Masaki | 123/489 |
| 4,359,993 | 11/1982 | Carlson | 123/492 |
| 4,397,278 | 8/1983 | Hughes | 123/489 X |
| 4,548,185 | 10/1985 | Pozniak | 123/478 X |
| 4,662,335 | 5/1987 | Kleeblatt | 123/489 X |

FOREIGN PATENT DOCUMENTS 2084353 4/1982 United Kingdom .

OTHER PUBLICATIONS

Patents Abstracts of Japan, vol. 7, No. 44 (M-195) [1189], Feb. 22, 1983.

*Primary Examiner*—Willis R. Wolfe

*Attorney, Agent, or Firm*—Oblon, Fisher, Spivak, McClelland & Maier

[57] ABSTRACT

According to this process, the computer determines opening time (Ti) of the injector from a nominal time (Tin) as a function of the parameters of the engine operation and of a proportional and integral correction term (α cl) as a function of the state of the signal of probe λ. More particularly, a richness predictive estimate (Re) of the exhaust gases is made from the engine operating parameters and from pure delay (m), determined experimentally, between injector (2) and probe (12), at least a simulated probe signal (Ss λ) is produced from said richness predictive estimate, said correction term (α cl) is produced from simulated probe signal (Ss λ) and said correction term (α cl) is modified periodically in response to the detection of a difference between the state of measured probe signal (S λ) and the state of a delayed simulated probe signal (S″s λ). Application to vehicles with internal combustion engines.

13 Claims, 5 Drawing Sheets

Δαcl
32
30
Gs/p
31
H1
29
Ssλ(n)
D+
D-
+1
0
-1
23
S'sλ(n)
D'+
D'-
Rc
22
21
K'(P,P̄)
20
K'
19
P̄
18
1/(1+δ'p)
16
1/(1+δp)
αcl initial
13
αcl
15
33
ᾱ
25
K''/N p e^(-p) (=m)
m=f(P)
24
K''
P
S''sλ(n)
26
28
K1/p
27
K2/p
Δα
Sλ(n)
17
Ti
ᾱ initial
14
34

50
PMH
51
FLAG.P=1 ?
N
Ø
αcl=αcl-G1Sλ(n)-H1(Sλ(n)-Sλ(n-1))
52
S''sλ(n)=S'sλ(n-m)
55
ᾱ=ᾱ+x(αcl-ᾱ)
53
ᾱ=ᾱ+K1(S''sλ(n)-Sλ(n))
56
S''sλ(n)=Sλ(n)
54
β=β+k(αcl-ᾱ-β)
57
P̄=P̄+x'(P-P̄)
58
Re=β-K'(P-P̄)-K2(S''sλ(n)-Sλ(n))
59
60
Re≥D+
62
Re≤D-
64
Re≥D'+
66
Re≤D'-
61
Ssλ(n)=+1
63
Ssλ(n)=-1
65
S'sλ(n)=+1
67
S'sλ(n)=-1
68
FLAG.P=1
69
CPT=0
FLAG.P=1
73
CPT=CPT-1
70
αcl=αcl-G1Ssλ(n)-H1(Ssλ(n)-Ssλ(n-1))
74
71
Ti=Tin(1+αcl/256)+Tio
72

PROCESS AND SYSTEM OF ELECTRONIC INJECTION WITH REGULATION BY PROBE λ FOR INTERNAL COMBUSTION ENGINE

BACKGROUND OF THE INVENTION

The invention relates to a process and a system of electronic injection with regulation by probe λ for an internal combustion engine of the type comprising at least an injector whose opening time is controlled by a computer as a function of the operating parameters of the engine and the stage of probe λ.

Probe λ is a sensor whose output voltage can swing between a high level (rich mixture) and a low level (poor mixture) located on both sides of a threshold corresponding to the stoichiometric ratio (richness "1"). The output signal of probe λ is formatted in the injection computer and the resulting logic information is a rectangular signal to which, by convention, is assigned the value "+1" when it is at the high level and the value "−1" when it at the low level.

The regulation adapted for this type of information is the superposition of a regulation of the proportional type and a regulation of the integral type. The proportional correction makes it possible to increase the regulation frequency, while the integral correction more particularly makes it possible to go from one functioning point to another adapted differently in richness, i.e., to respond to richness mismatching.

The closed loop regulation of the injection by means of a probe λ is essentially used when the exhaust system of the engine is equipped with a catalyst intended to reduce emissions of undesirable components (pollutants) of exhaust gases. Actually, this regulation makes it possible to control the richness of the air/fuel mixture admitted into the engine around the value $\lambda=1$, which is an essential condition for satisfactory combustion of the toxic components by the catalyst.

The good functioning of this latter therefore requires a regulation of the mixture which is exact and exhibits the smallest possible inertia. In other words, a high regulation frequency of the probe promotes an efficient functioning of the catalyst.

For this purpose, various solutions have been proposed to optimize the terms of proportional and integral correction and, despite certain efficiencies, these solutions encounter certain limits.

SUMMARY OF THE INVENTION

The invention proposes a process and a system of injection with regulation by probe λ which are basically different from the traditional solutions, while permitting the regulation frequency to increase considerably. Further, the invention can be combined with certain other traditional solutions to increase the efficiency of the regulation still more.

The aims of the invention are attained by means of a process of dosing of the fuel supplied to an internal combustion engine by at least an injector controlled by a computer associated with a probe delivering a signal able to take one or the other of two states as a function of the composition of the exhaust gases, according to which the computer determines the opening time of the injector starting from a nominal time as a function of the operating parameters of the engine and of a proportional and internal correction term as a function of the signal of the probe, characterized in that a predictive estimate of richness of the exhaust gases is made from the operating parameters of the engine gases and of the pure delay, determined experimentally, between the injector and the probe, at least a simulated probe signal is produced from said richness predictive estimate, said correction term is produced from the stimulated probe signal, and said correction term is periodically modified in response to the detection of a difference between the state of the measured probe signal and the state of a delayed simulated probe signal.

According to a characteristic, a first simulated probe signal is produced by comparison of the richness predictive estimate with the first high and low thresholds equal respectively to the high and low thresholds of the change of state of the probe, the delayed simulated probe signal is obtained by a time delay of said first signal equal to said pure delay, a second simulated probe signal is produced by comparison of the richness predictive estimate with the second high and low thresholds respectively greater than the first high and low thresholds, and said correction term is produced from the second simulated probe signal.

According to another characteristic, a reference term representative of the correction to be made to said nominal time is produced to obtain a probe state representative of richness "1" and an estimated gross richness value is calculated as a function of the difference between the correction term and reference term.

The invention also has as its object an electronic injection system for using the process defined above, comprising at least a fuel injector on the intake side of the engine, a probe sensitive to the composition of the exhaust gases, sensors for measuring the operating parameters of the engine and a computer which controls the opening time of the injector as a function of said parameters and of the output signal of said probe, characterized in that said system comprises a read-only memory of digital value of the pure delay addressable by the computer as a function of the air pressure at the engine intake.

BRIEF DESCRIPTION OF THE DRAWINGS

Other characteristics and advantages of the invention will come out from the following description of an embodiment given solely by way of example and illustrated by the accompanying drawings in which.

DETAILED DESCRIPTION OF THE PREFERRED EMBODIMENTS

Figure 1:
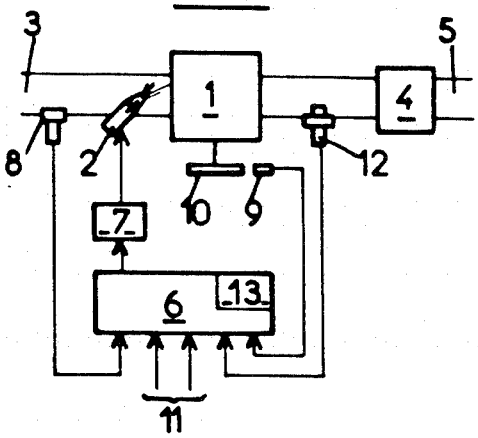
FIG. 1 is a block diagram of an injection system for using the process according to the invention.

The block diagram of FIG. 1 shows an internal combustion engine with controlled ignition 1 equipped with an injector 2 on the intake side 3 and a catalyst 4 for purifying the exhaust gases on the exhaust side 5.

Injector 2 is controlled by a programmed microcomputer 6 by means of a power circuit 7. Microcomputer 6 determines the nominal time Tin of opening of injector 2 as a function of the air pressure measured by a pressure sensor 8 placed on the intake side 3 and of the rotating speed of the engine. This latter information is delivered by a sensor 9 in front of which pass the teeth of a target 10 solid in rotation with the engine crankshaft. Target 10 can also be provided with one or more unevennesses placed in a predetermined angular position to provide information on angular position by means of sensor 9, or a second target associated with an additional sensor can be provided for this purpose.

Nominal time Tin can be corrected by microcomputer 6 as a function of other data such as the temperature of the atmospheric air, the temperature of the cooling water of the engine, etc . . . which it optionally receives on auxiliary intakes 11.

Nominal time Tin is also corrected from the information delivered by a probe λ 12 placed on the exhaust side 5, between engine 1 and catalyst 4. The output signal of probe λ is formatted in microcomputer 6 and then exhibits the shape of signal Sλ of FIG. 5. This signal Sλ contains a bit of information on the residual oxygen content of the exhaust gases, and also on the momentary ratio of air and fuel of the mixture sucked in by the engine. The high and low levels of this signal Sλ, to which are assigned the digital values "+1" and "−1" respectively correspond to the richnesses respectively higher and lower than the stoichiometric ratio (richness "1").

As will be seen below, the state of probe λ is not the instantaneous image of the richness of the mixture ideally taken into the engine because there is a pure delay between injector 2 and probe λ 12. This pure delay, determined experimentally, is stored in the form of digital values in a read-only memory 13 addressable by computer 6 as a function of the air pressure at the engine intake. Read-only memory 13 can be internal or external to computer 6.

It will be considered below that the unit described in FIG. 1 relates to a four-cylinder engine comprising a single injector that opens during a time Ti at each half-revolution of the engine. However it should be understood that the invention is in no way limited to this specific example and applies to any type of engine with controlled ignition, regardless of the number of injectors or cylinders with which it is equipped. Also, the parameters for computing nominal time Tin of opening of injector 2 are given solely by way of example and it is possible, among other things, to use an air flow sensor instead of a pressure sensor 8 on intake side 3. In this case, memory 13 containing the pure delay digital values is addressed as a function of the air flow instead of the pressure.

Time Ti of opening injector 2 computed by microcomputer 6 is given by the following formula:

$$Ti = Tin\left(1 + \frac{\alpha cl}{K}\right) + Tio \qquad (1)$$

where

Tin represents the nominal opening time computed in a standard way as a function of the main and auxiliary parameters of the operation of the engine mentioned above;

Tio is the time necessary for the injector to begin to deliver after its excitation by power circuit 7;

αcl is the term of correction or coefficient of regulation by probe λ;

K is a coefficient of value predetermined as a function of the precision desired in the correction of Tin.

In the case of an 8-bit microcomputer, it is possible to take K=256 and αcl can vary between 0 and 256, its nominal value being 128. Consequently, formula (1) can be written:

$$Ti = Tin\left(1 + \frac{\alpha cl}{256}\right) + Tio.$$

the term $$1 + \frac{\alpha cl}{256}$$

being able to vary between the value 1 (αcl=0) and the value 2 (αcl=256), the nominal value being 1.5 (αcl=128).

The coefficient αcl determines the proportional and integral corrections and is generally expressed by the formula:

$$\alpha cl(n) = \alpha cl(n-1) - H(S\lambda(n) - S\lambda(n-1)) - GS\lambda(n) \qquad (2)$$

where:

n represents the number of half-revolutions made by the engine since the last cycle of probe λ 12;

H is a fixed or variable coefficient determining the amplitude of the proportional correction;

G is a fixed or variable coefficient determining the gain of the integral correction.

As a variant, the gain of the integral correction can be an increasing function of the time lapsed since the last cycle of probe 12, for example, a parabolic function if αcl is in the following form:

$$\alpha cl(n) = \alpha cl(n-1) - H(S\lambda(n) - S\lambda(n-1)) - nGS\lambda(n) \qquad (3)$$

where G is then a predetermined fixed coefficient intervening in the determination of the gain of the integral correction.

The invention is distinguished from the conventional solutions of determination of the correction term αcl by the fact that for this purpose it does not directly use the measured probe signal Sλ but instead uses a simulated probe signal Ssλ.

The process according to the invention is actually based on the fact that injection time Ti is regulated from a richness estimate and that the observation of the measured probe signal Sλ serves to readjust this richness estimate periodically. This makes it possible to be independent of the pure delay between the injector and probe and, therefore, not to wait for its cycle to make the proportional correction, which has the result of increasing the frequency of richness detection oscillation.

Actually if it is assumed that $\overline{\alpha}$ is the value of $\alpha cl$ for which the injection time leads to a richness mixture 1, or $Ti(\overline{\alpha})=Ti$ richness 1, it is possible to write:

$$Ti(\alpha cl)-Ti(\overline{\alpha})=\Delta Ti/Ti \text{ richness } 1\neq\alpha cl-\overline{\alpha} \quad (4)$$

Considering the function of transfer between the injector and probe λ, we have:

$$\frac{\Delta \text{ richness}}{\text{richness } 1}=\frac{e^{-np}}{1+\tau p}\cdot\Delta Ti/Ti \text{ richness } 1 \quad (5)$$

Consequently, the term $$\beta(n)=\frac{\alpha(n)-\overline{\alpha}(n)}{1+\tau p}$$

is representative of richness deviation in relation to richness 1 at the point of probe λ at instant n+m+1, m representing the pure delay between the injector and the probe.

The closed loop predictive regulation process using this concept will be described now with reference to the flow sheet of FIG. 2.

Blocks 13 and 14 represent the initial values of $\alpha cl$ and $\alpha$ and the difference $\alpha cl-\overline{\alpha}$ is found at 15. Block 16 represents a low-pass filtering at the output of which the term $\beta=(\overline{\alpha cl=\alpha})$ is obtained.

Block 17 represents the unit of the system of FIG. 1 and receives injection time Ti and angular position Om of the engine from which is deduced number n of engine half-revolutions which have occurred since the last cycle of the probe. The output values of block 17 are measured pressure P and measured probe signal Sλ. Block 18 represents a low-pass filtering of pressure P and the difference $P-\overline{P}$ is found at 19. This difference is multiplied by coefficient K' at 20, term $K'(P-\overline{P})$ being positive in acceleration and negative in deceleration, and making it possible to take into account the problems of wetting of the walls of the intake manifold by the fuel. The difference $\beta-K'(P-\overline{P})$ is found at 22 and the term $K_2[Ss''\lambda(n)-S\lambda(n)]$ is subtracted from this difference at 22. Therefore at 22 a magnitude Re is obtained which constitutes an undelayed richness estimate at the level of the exhaust gases.

Block 23 represents the hysteresis of probe λ and reconstitutes at instant n (half-revolution n) of a simulated probe signal S'sλ which is a predictive estimate of what measured probe signal Sλ will be at instant n+m+1.

Moreover, block 24 represents the determination of pure delay m as a function of air pressure P measured at the intake of the engine. Block 25 represents a pure delay m provided by signal S'sλ(n), corresponding to a transfer function $$e-\frac{K''}{N}P,$$

and the difference between simulated probe signal S''sλ(n) and measured probe signal Sλ(n) is found at 26. This difference is multiplied by coefficient K2 at 27 to be reinjected at 22 as explained above. Moreover, this same difference S''sλ(n)−Sλ(n) is multiplied by K1 at 28 to be reinjected at 15.

Figure 5:
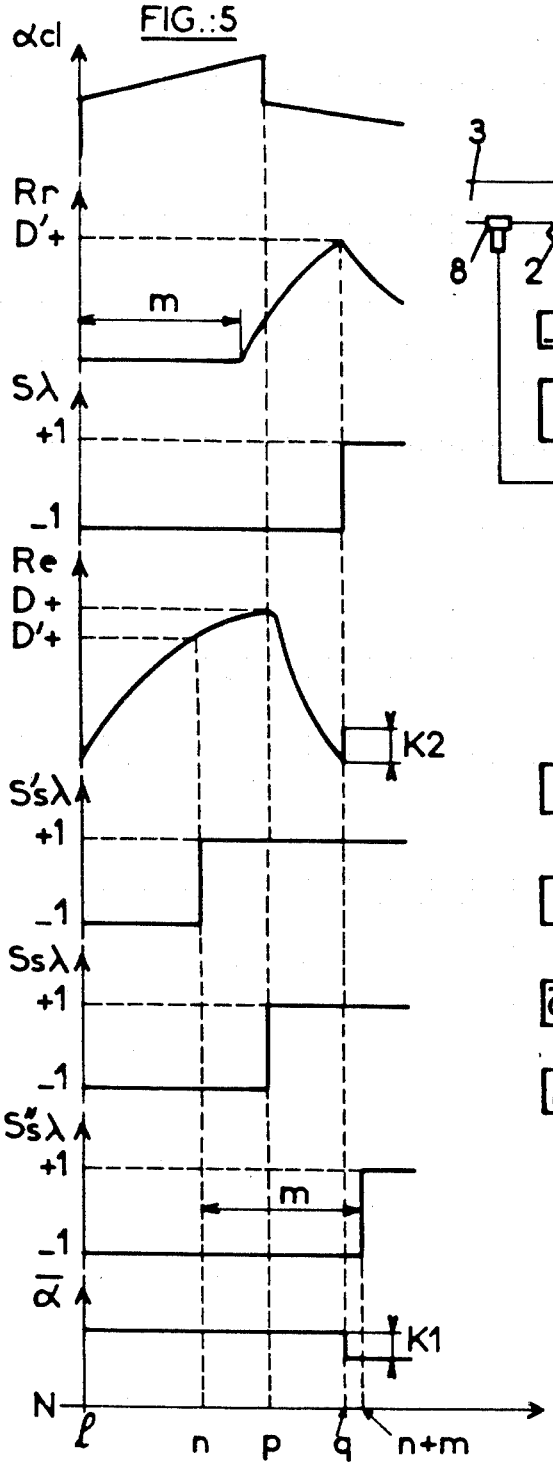
FIG. 5 is a timing diagram showing as a function of the number N of the half-revolutions of the engine, the evolution of a certain number of signals representative of the operation of the injection system according to the invention.

As shown in FIG. 5, a deviation between simulated probe signal S''λ(n) and measured probe signal Sλ(n) is caused by a poor estimate, therefore an error, on term $\overline{\alpha}$ ($\alpha cl$ is known), which therefore is corrected by means of coefficient K1 (integral correction), and as a consequence produces an error in the computing of the richness estimate which is corrected by means of coefficient K2 (integral correction).

The proportional and integral correction on coefficient $\alpha cl$ is made from a second simulated probe signal Ssλ(n) produced by block 29 from undelayed richness estimate Re. This block 29 has a greater hysteresis than block 23, which permits freer swings of probe 12 since richness excursions are amplified. Blocks 30 and 31 respectively represent the integral and proportional corrections, and the difference obtained at 32 represents the term $\Delta\alpha cl$ which is subtracted from the initial $\alpha cl$ at 33. Therefore at the output of 33 the term $\alpha cl$ is obtained which is injected at 15 with the term $\overline{\alpha}$ resulting from the difference found at 34 between initial $\overline{\alpha}$ (block 14) and calculated $\Delta\overline{\alpha}$ (block 28).

Figure 3:
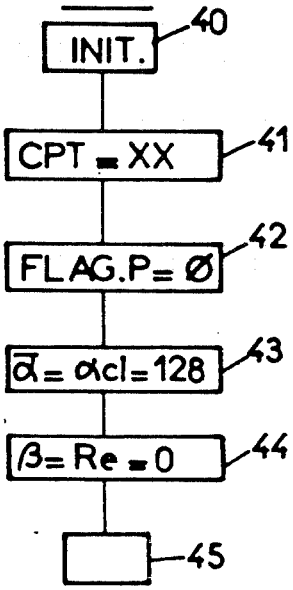
FIG. 3 is a flow chart illustrating the initialization program of the injection computer.
Figure 2:
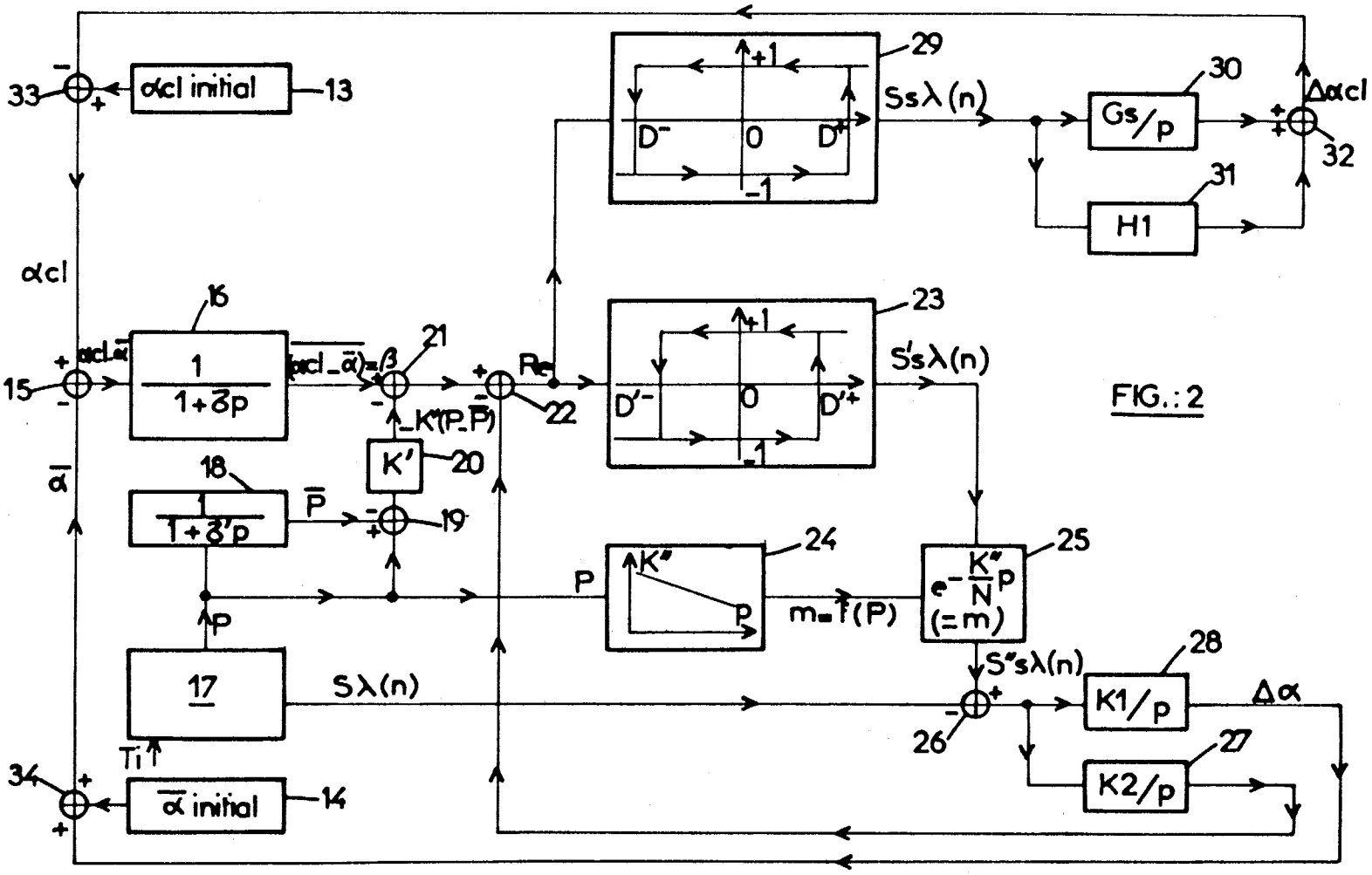
FIG. 2 is a flow chart illustrating the closed loop predictive regulation of the process according to the invention.
Figure 4:
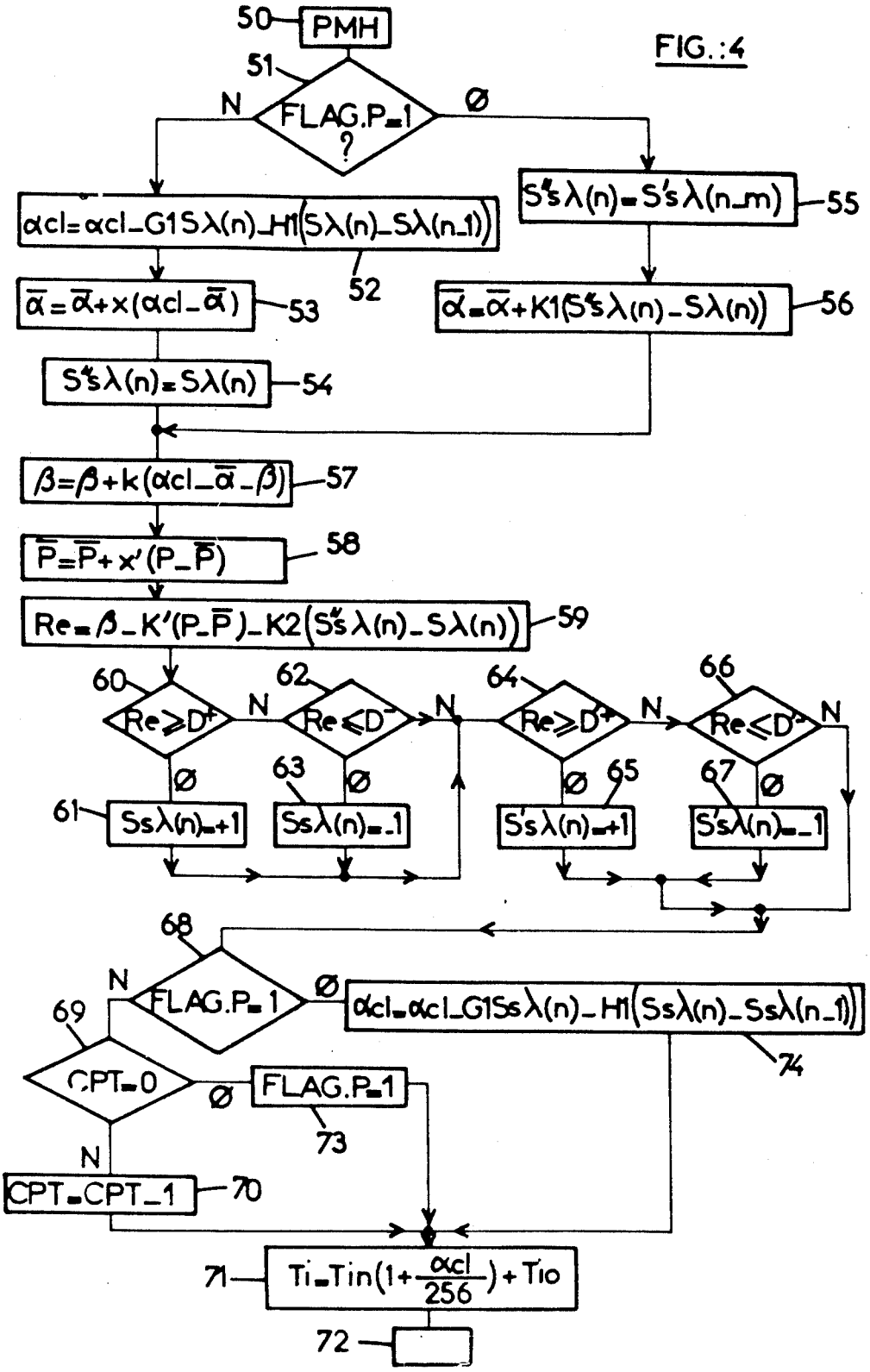
FIG. 4 is a functional flow chart of the injection computer for using the process of the invention.

FIG. 4 is a flow chart of the operation of computer 6 which makes it possible to use the automatic control diagram of FIG. 2. FIG. 3 is a flow chart of an initialization program which takes place during starting of the engine.

On receiving an initialization instruction (step 40), computer 40 loads a predetermined value XX into a computer CPT which counts down the engine half-revolutions (step 41). Following step 42 consists in sending a flag P at value 0, then initial values of $\overline{\alpha}$ and $\alpha cl$ at step 43 ($\overline{\alpha}=\alpha cl=128$) and of $\beta$ and Re at step 44 ($\beta=Re=0$) are assigned. Step 45 represents the end of the initialization program.

The execution of the main program of FIG. 4 will now be described also with reference to the timing diagram of FIG. 5. This program takes place at each detection of the passage of the engine by a predetermined angular position, for example, the passage of a piston through the top dead center (step 50). Following step 51 is a test to determine whether the engine is or is not yet in its starting phase. If such is the case, computer CPT has not yet be counted down and the flag assigned at step 42 of the initialization program is still at 0. The negative response to test 51 then leads to step 52 where correction term $\alpha cl$ is computed in a standard way from measured probe signal Sλ(n):

$$\alpha cl=\alpha cl-G1S\lambda(n)-H1(S\lambda(n)-S\lambda(n-1)).$$

At following step 53, reference term $\overline{\alpha}$ is computed:

$$\overline{\alpha}=\overline{\alpha}+x(\alpha cl-\overline{\alpha})$$

where x is a coefficient of predetermined fixed value. Step 54 which follows consists in giving to simulated probe signal S''sλ(n) the value which measured probe signal Sλ(n) exhibits at the nth half-revolution.

If, as will be explained below, the starting phase of the engine is finished and this latter has made a number of half-revolutions at least equal to that of XX assigned in computer CPT at step 41 of the initialization program, the value of the flag P will be fixed at 1 and the response to test 51 will be positive. At step 55, there is then given to delayed simulated probe signal S''sλ(n) the value exhibited by undelayed simulated probe signal S'sλ(n−m)—m half-revolutions later. This can be visualized in FIG. 5 where it is seen that signal S''sλ is offset in relation to signal S'sλ by pure delay m as a function of pressure P. Then at step 56 the reference term $\overline{\alpha}$ is computed:

$$\overline{\alpha(n)}=\overline{\alpha(n-1)}+K1(S''s\lambda(n)-S\lambda(n)).$$

Steps 54 and 56 both lead at step 57 to computing of the term $\beta$:

$$\beta(n)=\beta(n-1)+k[\alpha cl(n-1)-\overline{\alpha(n)}-\beta(n-1)]$$

where k is a coefficient of predetermined fixed value. Then at 58 a low-pass filtering is performed on the measured pressure: $\overline{P}=\overline{P}+x'(P-\overline{P})$ where x' is a coefficient of predetermined fixed value.

Following step 59 is the computation of undelayed richness predictive estimate Re:

$$Re=\beta(n)-K'(P-\overline{P})-K2[S''s\lambda(n)-S\lambda(n)].$$

Step 59 is followed by a series of tests to compare richness estimate Re at thresholds D+ and D−, on the one hand, and D'+ and D'−, on the other hand. Thresholds D+ and D− are symmetrical in relation to richness 1, like thresholds D'+ and D'− which are greater than thresholds D+ and D− respectively. For reasons of convenience, only thresholds D+ and D'+ are represented in FIG. 5, which corresponds to an operation with a rich mixture but it is possible to deduce immediately the various signals that would be obtained in case of operating with a lean mixture in comparison with the testimated richness Re with thresholds D− and D'−.

First test 60 which follows step 59 consists in comparing Re with threshold D+. If Re is greater than or equal to D+, the value +1 is assigned to signal SSλ(n) (stage 61). In the opposite case, one goes on to test 62 where Re is compared with threshold D−. If Re is less than or equal to D−, value −1 is assigned to signal Ssλ(n) (step 63). Steps 61 and 63 or a negative response to test 62 lead to test 64 where Re is compared with threshold D'+. If the response to this test is positive, value +1 is assigned to S'sλ(n) (step 65), while in the opposite case one goes on to test 66 where Re is compared with threshold D'−. If the response to this test is positive, value −1 is assigned to signal S'sλ(n) (step 67). Steps 65 and 67, as well as a negative response to test 66, lead to test 68. In case of a negative response to tests 60 and 62, Ssλ(n) retains the value that it had at instant n−1 and, also, in the case of a negative response to tests 64 and 66, S'sλ(n) retains the value that it had at instant n−1.

Test 68 relates to the value of the flag P. If it is still the starting phase of the engine, the flag still has the value 0 assigned at step 42 of the initialization program and the response to test 68 is negative and leads to a test 69 relating to the content of computer CPT initialized at value XX at stage 41 of the initialization program. In the starting phase, the content of computer CPT has still not been reset to 0 and the negative response to test 69 leads to stage 79 where computer CTP is decremented one unit.

Following step 71 consists in computing the injection time by using correction term αcl at step 52:

$$Ti = Tin\left(1 + \frac{\alpha cl}{256}\right) + TiO.$$

Following step 72 marks the end of the execution of the program which waits for the next interruption due to the passage of the engine through a predetermined angular position.

When the engine has made XX half-revolutions, the content of computer CTP has been counted down to 0 and the response to test 69 is positive. The flag P is then fixed at 1 (step 73), after which one goes on to step 71 of computing injection time Ti.

The engine starting phase is then ended and at the following half-revolution test 51 leads to performing steps 55 and 56. Also, the positive response to test 68 leads to step 74 where correction term αcl is computed as a function of simulated probe signal Ssλ:

$$\alpha cl=\alpha cl-G1Ss\lambda(n)-H1[Ss\lambda(n)-Ss\lambda(n-1)]$$

Then, while the engine is operating, term αcl is still calculated from simulated probe signal Ssλ, although it would be possible to consider returning to a traditional computation based on measured probe signal Sλ under certain particular operating conditions of the engine.

FIG. 5 clearly shows the pure delay which exists between injector 2 and probe 12: actually it is found that the real richness at the level of probe Rr, assumed to be initially at a plateau to facilitate understanding of the phenomenon described, begins to increase only m half-revolution after appearance of the increase of the richness of the mixture at the intake due to the proportional correction introduced in the presence of a jump of term αcl at assumed initial instant l. On the other hand, it is seen that predictive richness estimate Re begins to increase from half-revolution l to half-revolution p where it reaches threshold D+. This causes a change of state of simulated probe signal Ssλ used for computing αcl which, thereby, immediately provides a proportional correction followed by an integral correction. However, simulated probe signal S'sλ has already changed state half-revolution n when predictive richness estimate Re has reached threshold D'+ below threshold D+, so that delayed simulated probe signal S''sλ will also change state m half-revolution later, namely at half-revolutions n+m. However, it was assumed in the represented example that the real probe had cycled some time earlier, at half-revolution q. This means that the richness predictive estimate Re does not coincide exactly with the evolution of real richnes Rr at the level of probe λ and there results at half-revolution q a correction both of predictive richness estimate Re (coefficient K2) and of coefficient $\overline{\alpha}$ (coefficient K1).

In the example of using the invention by the flow chart of FIG. 4, term αcl of proportional and integral correction is assumed to be computed in the standard way as indicated by formula (2) cited above. However it should be noted that this term can also be calculated by formula (3) assuring an integral correction of parabolic type or any other suitable formula. Actually, the invention does not reside in the formula itself of computing this term but in the use, for this purpose, of a simulated probe signal based on a prediction of the evolution of the richness of the exhaust gases at the level of the real probe. In other words, the process and system described assure a richness from a signal simulated by an internal model and a recalibration of this internal model is performed periodically from observation of the state of probe λ. In the example described, the regulation of the injection time, which is based on simulated probe signal Ssλ, should be distinguished from the regulation of the internal model which resorts to the other simulated probe signal S'sλ and to the delayed simulated probe signal S''sλ. Of course, it is possible to perform the regulation of injection time Ti directly on simulated probe signal S'sλ but, as indicated above, the solution described makes it possible to assure freer cycling of the real probe 12 because richness thresholds D+ and D− used for producing of simulated probe signal Ssλ are greater than real thresholds D'+ and D'− of the swing of the probe. Other modifications can, of course, be made in the example of embodiment described without thereby going outside the scope and object of the invention.

Figure 6:
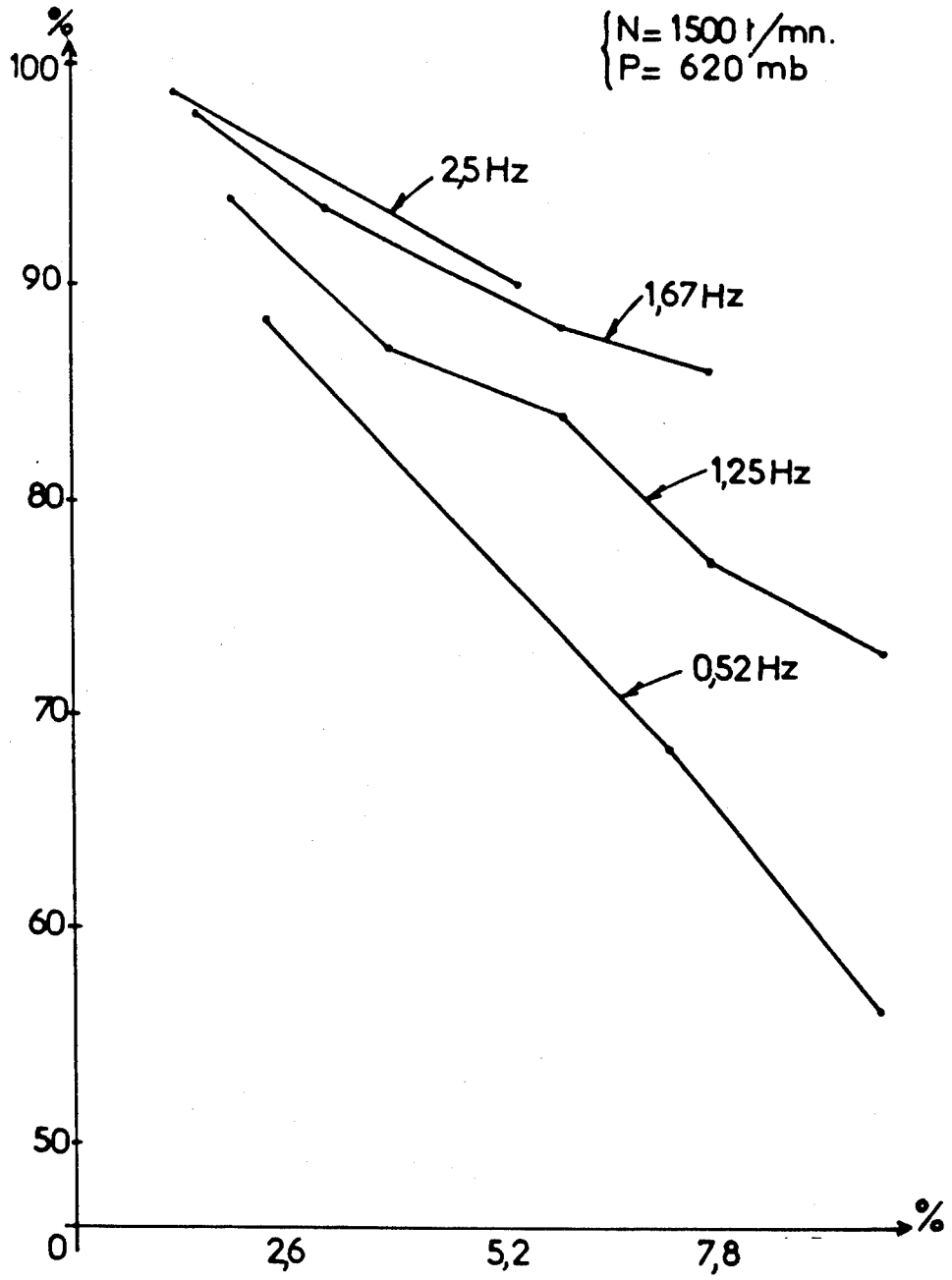
FIGS. 6 to 8 are graphs respectively showing the efficiency of a catalytic converter and the spectral analysis of the engine period with and without the process of the invention.

FIG. 6 represents at various excitation frequencies of the term αcl the efficiency of a 54000-mile trifunctional catalyst as a function of the peak to peak richness oscillations at the input of the catalytic converter. The efficiency is computed as follows, expressed in percentage:

Pollutant value before catalyst-pollutant value after catalyst

Pollutant value before catalyst

This graph that the efficiency is greater the higher the frequency and the smaller the amplitude of the richness oscillations. Now, precisely the process according to the invention makes it possible to increase this frequency and, for a given gain H1, to reduce the amplitude of the richness oscillations.

Figure 7:
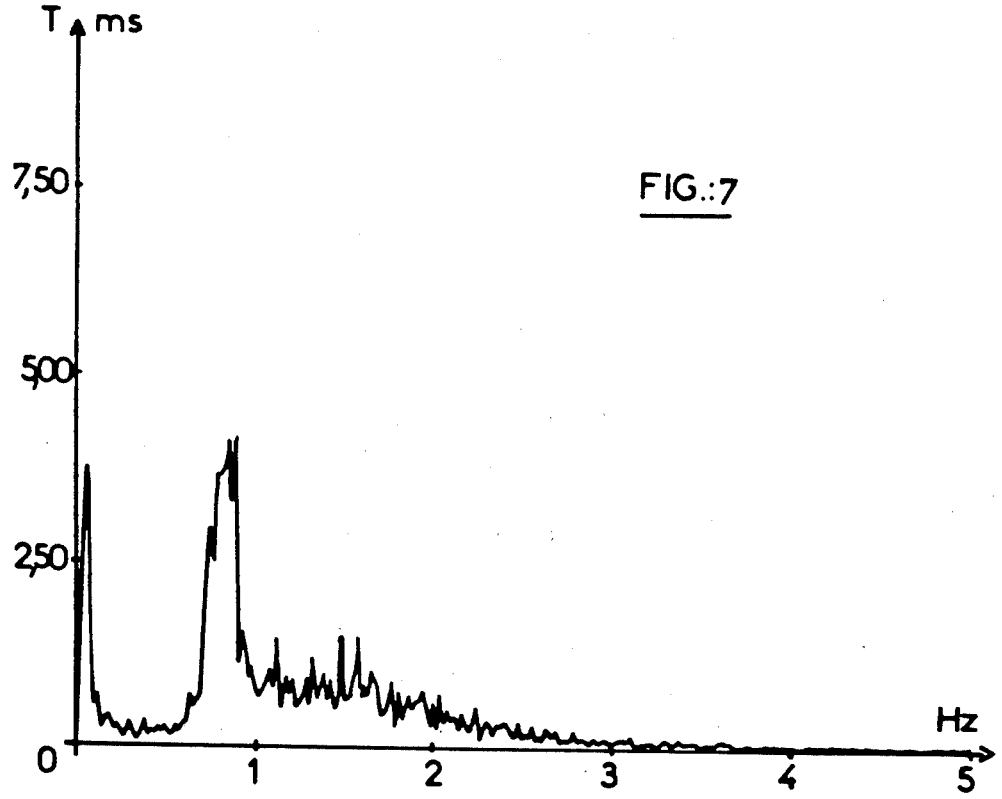
Figure 8:
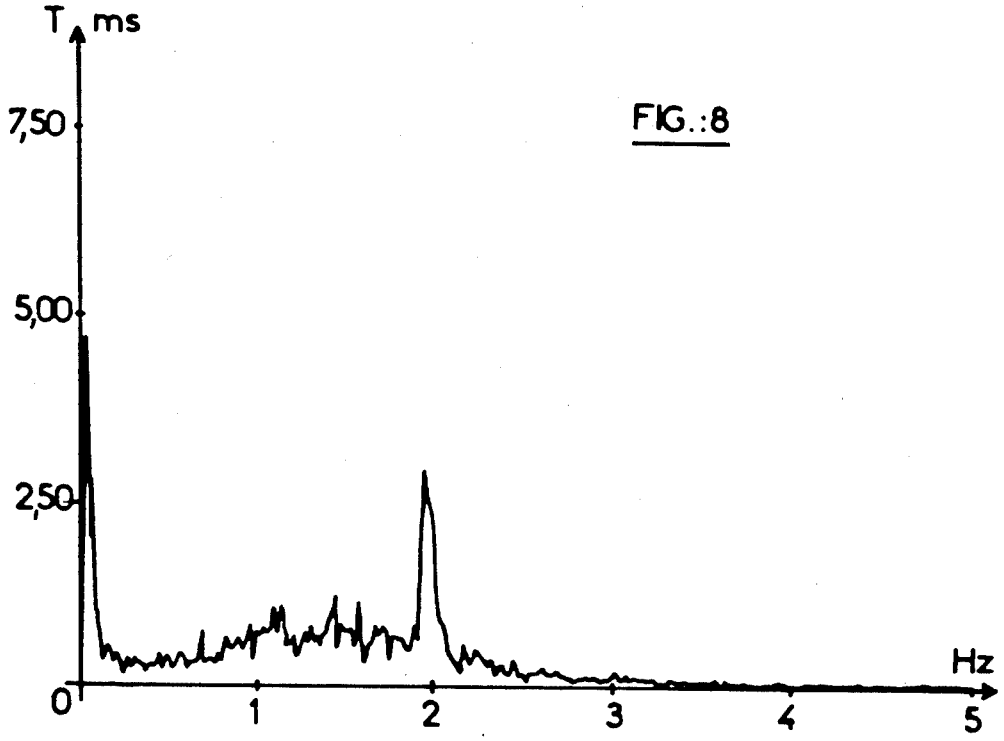

This increase of frequency is shown in FIGS. 7 and 8 which relate to an internal combustion engine controlled respectively by a standard fuel injection process and the process according to the invention. These curves represent the spectral analysis of engine period T expressed in milliseconds during idling. It comes out that in the first case the basic line is located around 0.9 Hz, while it is close to 2 Hz with the process according to the invention.

This frequency increase is reflected not only by a gain in the efficiency of the catalytic converter, but also by a reduction of the low frequency pumping of the engine speed at idling, hence there is an improvement of the vibratory comfort in the vehicle perceptible by a driver.

We claim:

1. Process of metering of the fuel supplied to an internal combustion engine by at least an injector controlled by a computer associated with a probe delivering a signal (Sλ) which is able to take one or the other of two states as a function of the composition of the exhaust gases, said process comprising the steps of using the computer to determine an opening time (Ti) of the injector from a nominal time (Tin) which is a function of operating parameters of the engine and from a proportional and integral correction term (αcl) which is a function of the state of the probe signals, said correction term (αcl) being determined from a simulated probe signal (Ssλ) based upon a richness predictive estimate (Re) of the exhaust gases, estimate (Re) being determined from the operating parameters of the engine and from an experimentally determined pure delay (m) between the injector and the probe, and periodically modifying said correction term (αcl) in response to a detection of a difference between the stat of measured probe signal (Sλ) and the state of a delayed simulated probe signal (S''sλ).

2. Process according to claim 1, wherein a first simulated probe signal (S'sλ) is produced by a comparison of said richness predictive estimate (Re) with first high and low thresholds (D'+, D'−) equal respectively to high and low thresholds of change of state of the probe, the delayed simulated probe signal (S''sλ) being obtained by a time delay of said signal (S'sλ) equal to said pure delay (m), a second simulated probe signal (Ssλ) being produced by comparison of said richness predictive estimate (Re) with second high and low thresholds (D+, D−) higher respectively than first high and low thresholds, and said correction term (αcl) being produced from the second simulated probe signal (Ssλ).

3. Process according to claim 2, wherein there is produced a reference term ($\bar{\alpha}$) representative of the correction to be made to said nominal time (Tin) to obtain a state of the probe representative of richness "1" and a richness estimated rough value (β) is computed as a function of the difference between the correction term (αcl) and the reference term ($\bar{\alpha}$).

4. Process according to claim 3, wherein said reference term ($\bar{\alpha}$) is produced as a function of the difference between the state of the delayed simulated probe signal (S''sλ) and the state of the measured probe signal (Sλ).

5. Process according to any one of claims 3 or 4, wherein said richness predictive estimate (Re) is equal to the total of said rough value (β), of a first term (K'(P−$\bar{P}$) as a function of an air pressure at an engine intake and of a second term (K2(S''sλ−Sλ)) as a function of the difference between the state of the delayed simulated probe signal (S''sλ) and the state of the measured probe signal (Ssλ).

6. Process according to claim 5, wherein the state of the probe is detected and time (Ti) of the opening of the injector is computed cyclically at each revolution or fraction of revolution of the engine, wherein said richness predictive estimate Re is expressed by:

$$Re(n)=\beta(n)-K'(P-\bar{P})-K2(S''s\lambda(n)-s\lambda(n))$$

where

β is a richness estimated rough value,

K' is a coefficient of predetermined value,

P is the air pressure at the engine intake, $\bar{P}$ represents pressure P seen through a low-pass filter K2 is a coefficient of predetermined value, Sλ(n) is the value that the measured probe signal exhibits n cycles after the last cycle of the probe, S''λ(n) is the value that the delayed simulated probe signal exhibits at cycle n, signals Sλ(n) and S''sλ(n) being able to take values +1 or −1.

7. Process according to claim 6, wherein the richness estimated rough value at cycle n is expressed by $$\beta(n)=\beta(n-1)+k[\alpha cl(n-1)-\bar{\alpha}(n)-\beta(n-1)],$$

where:

β(n−1) is the richness estimated rough value at cycle n−1, k is a coefficient of predetermined value, αcl(n−1) is the correction term computed at cycle n−1, α(n) is the reference term computed at cycle n.

8. Process according to claim 7, wherein the value of the reference term at cycle n is expressed by:

$$\bar{\alpha}(n)=\bar{\alpha}(n-1)+K1[S''s\lambda(n)-S\lambda(n)],$$

where:

$\alpha(n-1)$ is the value of the reference term at cycle $n-1$,

K1 is a coefficient of predetermined value.

9. Process according to any one of claims 2 to 4, wherein the value of the correction term n cycles after the last cycle of the probe is expressed by:

$$\alpha cl(n-)=\alpha cl(n-1)-G1Ss\lambda(n)-H1(Ss\lambda(n)-Ss\lambda(n-1)),$$

where $\alpha cl(n-1)$ is the value of the correction term at cycle $n-1$,

G1 is a coefficient used in the determination of the gain of the integral correction, H1 is a coefficient determining the amplitude of the proportional correction, $Ss\lambda(n)$ is the value that the second simulated probe signal exhibits at cycle n, $Ss\lambda(n-1)$ is the value the second simulated probe signal exhibits at cycle $n-1$, signal $Ss\lambda$ being able to take values $+1$ or $-1$.

10. Process according to any one of claims 2 to 4, wherein the value of the correction term n cycles after the last cycle of the probe is expressed by:

$$\alpha cl(n-)=\alpha cl(n-1)-H2[Ss\lambda(n)-Ss\lambda(n-1)]-nG2Ss\lambda(n-),$$

wherein:

$\alpha cl(n-1)$ is the value of the correction term at cycle $n-1$,

H2 is a coefficient determining the amplitude of the proportional correction,

G2 is a coefficient used in the determination of the integral correction, $Ss\lambda(n)$ is the value that the second simulated probe signal exhibits at cycle n, $Ss\lambda(n-1)$ is the value that the second simulated probe signal exhibits at cycle $n-1$, signal $Ss\lambda$ being able to take values $+1$ or $-1$.

11. Process according to any one of claims 1 to 4, wherein said pure delay (m) is a function of air pressure (P) at an engine intake.

12. Process accrding to claim 11, wherein said pure delay (m) is a digital value expressed in a number of engine revolutions or fractions of a revolution.

13. System of electronic injection for metering of the fuel supplied to an internal combustion engine by determining an opening time (Ti) of an injector from a nominal time (Tin) which is a function of operating parameters of the engine and from a proportional and integral correction term ($\alpha cl$) which is a function of the state of the probe signal, said correction term ($\alpha cl$) being determined from a simulated probe signal ($Ss\lambda$) based upon a richness predictive estimate (Re) of the exhaust gas, estimate (Re) being determined from the operating parameters of the engine operation and from an experimentally determined pure delay (m) between the injector and the probe, and periodically modifying said correction term ($\alpha cl$) in response to a detection of a difference between the state of measured probe signal ($S\lambda$) and the state of a delayed simulated probe signal ($S''s\lambda$), said system comprising at least one fuel injector on an engine intake side, a probe sensitive to the composition of the exhaust gases, sensors for measuring operating parameters of the engine and a computer which controls the opening time of the injector as a function of said parameters and of the output signal of said probe, wherein said system includes a read-only memory of digital values of pure delay (m) addressable by said computer as a function of air pressure (P) at the intake of engine.

* * * * *